US006005470A

United States Patent [19]

Smith et al.

[11] Patent Number: 6,005,470

[45] Date of Patent: Dec. 21, 1999

[54] ARC-QUENCHING FILLER FOR HIGH VOLTAGE CURRENT LIMITING FUSES AND CIRCUIT INTERRUPTERS

[75] Inventors: James D. B. Smith, Monroeville; John J. Shea, Ross Township; William R. Crooks, Mt. Lebanon, all of Pa.

[73] Assignee: Eaton Corporation, Cleveland, Ohio

[21] Appl. No.: 08/745,386

[22] Filed: Jul. 28, 1995

Related U.S. Application Data

[63] Continuation of application No. 08/165,201, Dec. 13, 1993, abandoned.

[51] Int. Cl.[6] ..... H01H 85/38

[52] U.S. Cl. ..... 337/273; 337/276

[58] Field of Search ..... 337/273, 276

[56] References Cited

U.S. PATENT DOCUMENTS

| | | | |
|---|---|---|---|
| 2,526,448 | 8/1950 | Amundson et al. . | |
| 3,562,192 | 2/1971 | Conard | 260/305 |
| 3,582,586 | 6/1971 | Jones . | |
| 3,761,660 | 9/1973 | Jones . | |
| 3,843,948 | 10/1974 | Kozacka | 337/158 |
| 3,925,745 | 12/1975 | Blewitt . | |
| 4,035,755 | 7/1977 | Cameron . | |
| 4,099,153 | 7/1978 | Cameron . | |
| 4,166,266 | 8/1979 | Kozacka et al. . | |
| 4,167,723 | 9/1979 | Wilks . | |
| 4,179,677 | 12/1979 | Kozacka et al. . | |
| 4,251,699 | 2/1981 | Wiltgen, Jr. . | |
| 4,307,368 | 12/1981 | Reid . | |
| 4,309,684 | 1/1982 | Wilks . | |
| 4,319,212 | 3/1982 | Leach . | |
| 4,339,742 | 7/1982 | Leach et al. . | |
| 4,444,671 | 4/1984 | Wiltgen, Jr. . | |
| 4,625,195 | 11/1986 | Robbins . | |
| 4,638,283 | 1/1987 | Frind et al. . | |
| 4,975,551 | 12/1990 | Syvertson . | |
| 4,995,886 | 2/1991 | Cameron et al. . | |

FOREIGN PATENT DOCUMENTS

| | | |
|---|---|---|
| 2112283 | 3/1971 | Germany . |
| 3039987 | 10/1980 | Germany . |

*Primary Examiner*—Lincoln Donovan
*Attorney, Agent, or Firm*—Martin J. Moran

[57] ABSTRACT

A high voltage circuit interrupter has a surface modified pulverulent arc-quenching filler composition, with gas-evolving material is bound to the surfaces of the arc-quenching filler by a binder. The pulverulent arc-quenching filler can be selected from the group of silicas and silicates, preferably sand, mica or quartz. The gas-evolving materials can be selected from the group of melamine, cyanuric acid, melamine cyanurate, guanidine, guanidine carbonate, guanidine acetate, 1,3-diphenylguanidine, guanine, urea, urea phosphate, hydantoin, allantoin, and mixtures and derivatives thereof. The device has a generally tubular casing of electrically insulating material, terminal elements closing the opposite ends of the casing, at least one fuse element conductively interconnecting the terminal elements, a core for supporting the fuse element, extending parallel to the longitudinal axis, and a modified pulverulent arc-quenching filler material inside the casing, in close proximity to the fuse element. The modified pulverulent arc-quenching filler material includes a pulverulent arc-quenching filler, a binder, and a gas-evolving material, and the gas-evolving material is bound to the surfaces of the arc-quenching filler.

26 Claims, 3 Drawing Sheets

ARC-QUENCHING FILLER FOR HIGH VOLTAGE CURRENT LIMITING FUSES AND CIRCUIT INTERRUPTERS

This application is a continuation of application Ser. No. 08/165,201, filed Dec. 13, 1993 now abandoned.

BACKGROUND OF THE INVENTION

Field of the Invention

The invention relates to the field of high voltage circuit interruption in electrical devices such as switchgear, transformers, and the like, and in particular concerns high voltage current limiting fuses or expulsion fuses, circuit breakers, circuit interrupters, separable cable connectors, or the like, including a pulverulent arc-quenching filler material of high dielectric strength that is adapted to aid in arc extinction, and to quickly and effectively to break the circuit. More particularly, the invention is directed to an arc-quenching filler material encased within a high voltage current limiting device that is surface modified with a gas-evolving composition to provide improved arc-quenching properties without impairing the free flowing and compacting properties of the arc-quenching filler material. The invention also concerns a method of making the same.

Current limiting power interruption in high voltage circuits requires a current interruption device that rapidly and effectively brings the current to a zero value upon the occurrence of a line fault. The fuse devices generally considered herein are those employed in electrical circuits typically at voltages of a thousand or more volts. Electrical circuits operating at such high levels of voltage can cause extensive damage to circuit components, machinery connected to the circuit, or the like if the current interruption is not accomplished positively in a short period following the occurrence of fault or overload conditions.

Expulsion fuses or gas-evolving fuses in particular have been used extensively for high voltage circuit interruption in switchgear, transformers, and other electrical equipment. It is generally known that arc-quenching and gas-evolving materials in such a circuit interruption device, positioned in contact with the fuse element, aid in, inter alia, deionizing, cooling, and thereby quenching the electric arc created under fault or overload current conditions.

It is known to provide a pulverulent (powder) arc-quenching filler material, for example sand, inside the, casing of a fuse to absorb the energy of a burning or fusing fuse element during the fusing process so that the fuse will not explode when interrupting the circuit. The conventional arc-quenching filler material tends to confine the arc radially and thus to sustain its current limiting voltage, in addition to absorbing the energy of the arc. However, such fuse when operating under low current conditions may arc for an extended period if time during which the sand or powdered arc-quenching filler may be heated sufficiently to be fused. In the fused state, the conventional arc-quenching filler suffers a loss in insulation properties which can be sufficient to prevent interruption of the current or to allow a restrike after a temporary interruption. It has been difficult to obtain, however, an arc-quenching filler material that is substantially resistant to a fused state, thereby forming fulgurites.

It is also known to provide mandrels or cores of gas-evolving materials to evolve an arc-quenching gas during the fusing operation. To avoid excessive pressures against the inside of the fuse housing and ferrules which may lead to rupture of the fuse housing or blow off the ferrules, the amount of evolved gas can be reduced by locally positioning gas-evolving materials in controlled small quantities along the core. The pressure within the fuse housing does not, therefore, increase unduly, and the positive effects of the presence of arc suppressing gas are generally maintained. It has been difficult to obtain, however, a gas-evolving material whose solid residue in the fused state is relatively non-conductive, so as to prevent restriking or tracking of the arc by conductance through the fused compound, and a tendency to reestablish a current flow through the material after interruption.

A typical high voltage fuse can include a generally tubular casing of electrically insulating material; a pair of terminal elements closing each of the opposite ends of the casing; a pulverulent arc-quenching filler material of high dielectric strength inside the casing, such as sand, mica beads, or finely divided quartz; a fuse element or elements made of a highly conductive material, such as silver, submersed in the filler and conductively interconnecting the terminal elements, the fuse element or elements typically being wound in a parallel-connected relationship along the length of a supporting mandrel or core; a core of high dielectric strength electrically insulating high temperature material, such as ceramic, the core providing support for the fuse element or elements and having longitudinally and radially extending fins of a cross-shaped, star-shaped or like cross-section, along the longitudinal axis of the casing; and a gas-evolving material regionally distributed along the length of the core in contact with the fuse element or elements.

In operation, when the high voltage current limiting fuse is subjected to an applied current that exceeds the rated current carrying capability of the fuse element, the excessive current causes sufficient resistive heating that the fuse element attains a fusion temperature. Melting and vaporization of the fuse element occur at one or more predetermined locations along its length, whereupon an electrical arc is established in each region where the fuse element melts. A plurality of series connected arcs can be formed along the fuse element. Current limitation occurs when the sum of the individual arc voltages reaches the voltage applied to the fuse. Thus, the current limiting effect results from the introduction of arc resistance in series with the circuit.

When electrical arcing occurs, the fuse element and/or its metal vapors rapidly expand to many times the volume originally occupied by the fuse element. These metal vapors expand into the spaces between portions of the arc-quenching filler material where they condense through heat transfer into the arc-quenching filler, and consequently are no longer positioned for current conduction. The physical contact between the hot arc and the relatively cool arc-quenching filler granules causes a rapid transfer of heat from the arc to the granules to dissipate most of the arc energy without substantial pressure buildup within the fuse casing. A material that rapidly evolves a deionizing gas may be distributed along the length of the core to reduce conduction through gas that may be ionized by the arc and to cool the arc, which facilitates arc extinction under low current conditions.

However, after this fusing operation occurs, fulgurites are formed in the pulverulent arc-quenching filler material. That is, the pulverulent arc-quenching filler material is fused or sintered in the hot arcing regions into a glass-like body defining a path of relatively lower resistance than the surrounding pulverulent material. The fulgurites provide a path along which restrike of the arc current can occur. There is a need to provide a high voltage current limiting device that uses the beneficial properties of energy-absorbing pulverulent arc-quenching filler material and localized evolvement of arc-suppressing gas while at the same time reducing the tendency to form conductive fulgurites in the fusing region.

A typical arc-extinguishing gas-evolving material may comprise a combination of a gas-evolving material and a thermoplastic or thermosetting polymeric structural binder. Such material generally is highly carbonizing and therefore conductive. Upon gas evolution, the organic binder decomposes, leaving conductive carbon residues. There is a need to provide a high voltage current limiting device that uses the properties of energy-absorbing pulverulent arc-quenching filler material and localized evolvement of arc-suppressing gas while reducing the tendency to form carbon residues in the fusing region. Carbon residue likewise enhances the opportunity for a restrike of the arc, which is undesirable.

U.S. Pat. No. 4,099,153 (Cameron) teaches a high voltage current limiting fuse comprising a fuse element wrapped about an electrically insulating support mandrel or core along the core length, the fuse element being held in position on the core by gas-evolving C-clamps locally distributed along the length of the core. The core, fuse element, and gas-evolving clamps are embedded in a pulverulent arc-quenching filler inside a casing. Cameron teaches positioning the gas-evolving clamps in contact with the fuse element in localized regions. Upon fusing and arcing, the pressure of the evolved gas forces the arc-quenching filler away form the restricted arcing regions. Cameron claims that this reduces formation of fulgurites in those regions during fusing, so that undesirable restriking of the arc will not occur.

U.S. Pat. No. 4,319,212 (Leach) teaches a high voltage current limiting fuse comprising a fuse element wrapped about a finned core with cutouts along its length, and with gas-evolving materials positioned in the cutouts. The core, fuse element, and the gas-evolving material are surrounded by a granular arc-quenching filler material inside a casing. Leach teaches positioning the arc-quenching pulverulent filler in the immediate vicinity of the arc-initiating fuse element. The filler absorbs the arc energy as the fuse element melts, and forms fulgurites which Leach claims are cooled and rendered insulating, rather than conductive, by evolved gases also in close proximity to the arc-initiating fuse element melts and the arc-quenching filler material.

U.S. Pat. No. 3,582,586 (Jones) teaches a gas-evolving material comprising melamine and a thermoplastic or thermosetting organic binder. As discussed above, such gas-evolving material has a tendency to carbonize in air under arcing conditions to form conductive carbon residues which enhances arc restriking and tracking.

U.S. Pat. No. 3,761,660 (Jones) teaches a gas-evolving material comprising melamine, hydrated alumina and a thermoplastic or thermosetting organic binder. The hydrated alumina is provided to release the water of its hydration to enhance arc-quenching properties and to catalyze the oxidation of carbonaceous materials to reduce carbon residue formation. A drawback of hydrated materials in a current limiting device is the tendency to cause corrosion as a result of evolution of water from the hydrated material, and ionization during arcing.

U.S. Pat. No. 4,975,551 (Syverston) teaches a gas-evolving material comprising of melamine or other related compounds containing carboxylic reactive groups, such as amine, hydroxyl, epoxy, aziridine, or thiol groups, and a thermoplastic polymer containing carboxylic acid moieties which chemically bond to the melamine or related compounds carboxylic acid reactive group. Carboxylic acid moieties are highly carbonizing in their fused state and, consequently, have a tendency to track the arc.

It would be desirable to provide a pulverulent arc-quenching filler material that has its surfaces modified with a relatively non-carbonizing gas-evolving material that can be used in a high temperature current limiting device to rapidly and effectively quench an arc. It would be further desirable to provide a pulverulent arc-quenching filler material modified with a relatively non-carbonizing gas-evolving material that maintains the free flowing and compacting characteristics of the pulverulent arc-quenching filler material. It would also be desirable to provide a pulverulent arc-quenching filler material modified with a relatively non-carbonizing gas-evolving material that tends to quench the follow current, i.e., the current which flows through the hot fulgurite after a fusing operation, through cooling of the fulgurites by the evolved gas. The evolved gas of such gas-evolving material on the surface of the arc-quenching filler material advantageously produces a deionizing action on the arc initiated by vaporization of the fuse element, and reduces the tendency for a restrike or track of the arc by reducing fulgurite formation and/or cooling the fulgurite formed to a more insulating and less conductive body. Such modified arc-quenching filler material can be provided in direct contact with the fuse element.

SUMMARY OF THE INVENTION

It is an object of the invention to modify pulverulent arc-quenching filler material surfaces with gas-evolving materials for use in high voltage current limiting devices, and thereby improve their operational characteristics.

It is another object of the invention to extinguish an electric arc in a high voltage current limiting device efficiently and effectively, with an arc-quenching filler material having a surface coating of a gas-evolving material.

It is an advantage of the invention that tracking or restriking of an arc is less likely.

It is another advantage of the invention that fulgurite formation in the arc-quenching filler material is reduced.

It is a further advantage of the invention that compacting and free-flowing properties of the arc-quenching filler material are maintained.

These and other objects and advantages are accomplished according to the invention by providing a surface modified pulverulent arc-quenching filler composition, including a pulverulent arc-quenching filler material, a binder, and a gas-evolving material, wherein the gas-evolving material is bound to the surface of said arc-quenching filler. The pulverulent arc-quenching filler can be selected from the group of silicas and silicates, preferably sand, mica or quartz. The gas-evolving materials can be selected from the group of melamine, cyanuric acid, melamine cyanurate, guanidine, guanidine carbonate, guanidine acetate, 1,3-diphenylguanidine, guanine, urea, urea phosphate, hydantoin, allantoin, or the like and mixtures and derivatives thereof.

The high voltage current limiting device according to the invention includes a generally tubular casing of electrically insulating material; a pair of terminal elements closing each of the opposite ends of the tubular casing; at least one fuse element conductively interconnecting the pair of terminal elements; a core for supporting at least one fuse element, longitudinally extending parallel to the longitudinal axis of the tubular casing; a modified pulverulent arc-quenching filler material inside the tubular casing in close proximity to the fuse element, wherein the modified pulverulent arc-quenching filler material comprises a pulverulent arc-quenching filler material, a binder, and a gas-evolving material, wherein the gas-evolving material is bound to the surface of said arc-quenching filler material.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
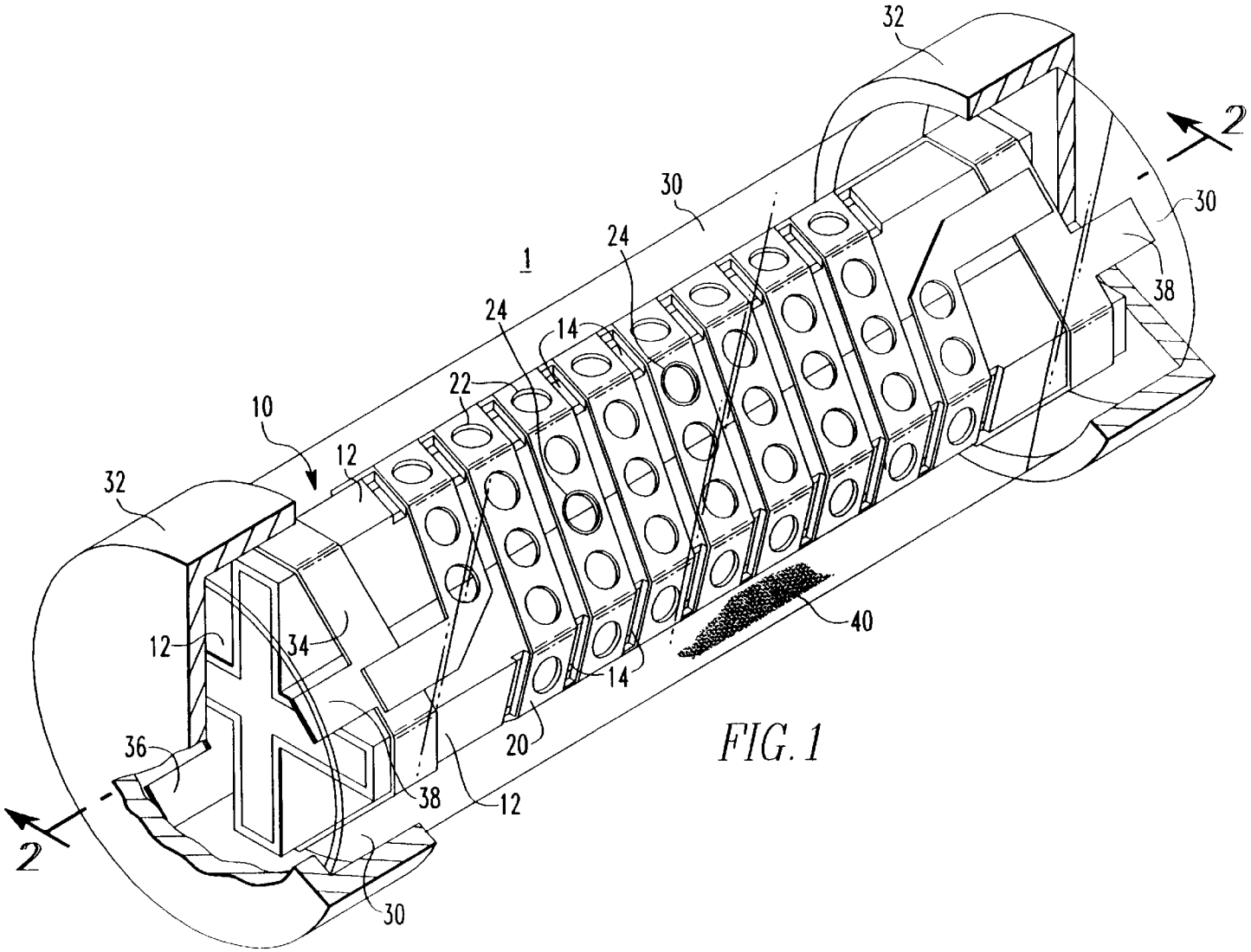
FIG. 1 is a perspective view of a high voltage current limiting device having the surface modified pulverulent arc-quenching filler material according to the invention encased therein.
Figure 2:
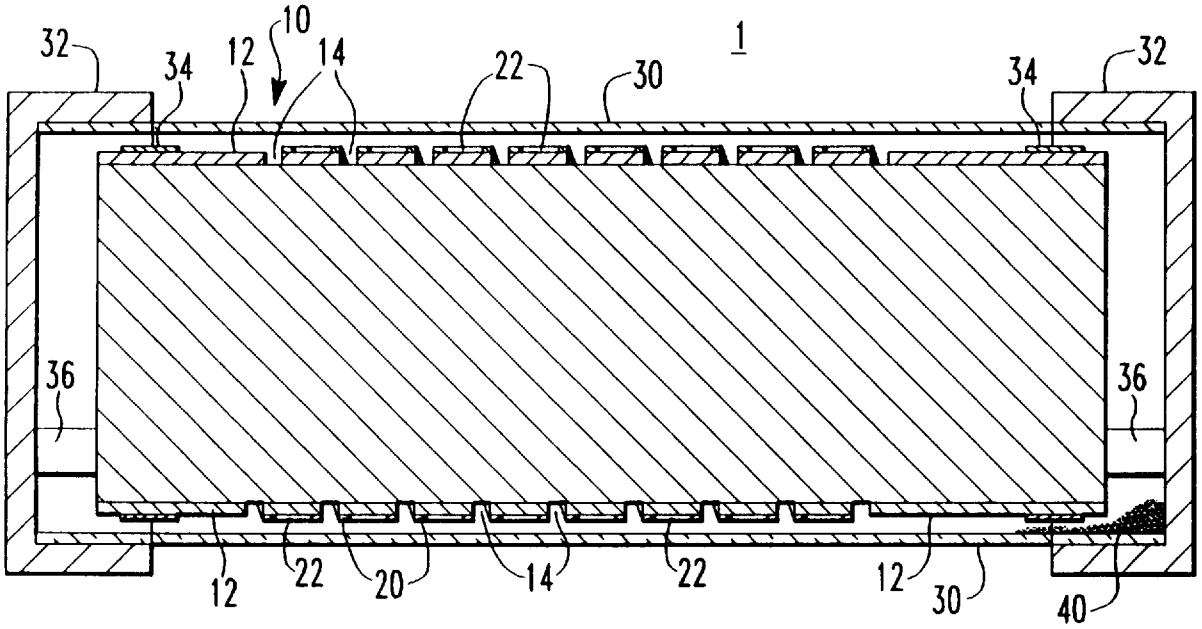
FIG. 2 is a cross-sectional view of FIG. 1 along line 2—2.

FIG. 1 is a perspective view of a high voltage current limiting fuse 1, according to the present invention. FIG. 2 is a cross-sectional view of the high voltage current limiting fuse of FIG. 1. Generally, the high voltage current limiting fuse 1 includes a mandrel or core 10 about which is wound a conductive fuse element 20. The core 10 and the fuse element 20 are typically located in a tubular insulating housing or casing 30, having electrical terminals or ferrules 32 at the opposite ends of the tubular casing 30 to close each of the opposite ends and to provide an electric circuit with the fuse element 20 serially connecting the ferrules 32. A single fuse element 20 is shown wrapped about the core 10 for purposes of illustration. It should be understood that a fuse construction can also include a plurality of fuse elements 20, electrically connected in parallel, wrapped about the core 10 and interconnect the terminals or ferrules 32 of the fuse.

The core 10 typically comprises a high dielectric strength, electrically-insulating high temperature material such as, for example, ceramic. The core 10 is further typically formed to have a cross-shaped, star-shaped, or the like cross-section and includes generally radially projecting fins 12 that extend longitudinally along the length of the fuse casing 30. Such a fin design is known, and is desirable in that it reduces the contact area between the fuse element 20 and the core 10. By reducing the contact area between core 10 and fuse element 20, the performance of the high voltage fuse is improved as compared to a cylindrical core.

The fuse element 20 typically has a ribbon-type form and is made of a high conductivity material, such as, for example, silver. Preferably, the fuse element 20 is spirally or helically wound about the core 10 such that successive wraps are spaced-apart along the core axis. The fuse element 20 can also be made of aluminum, copper, tin, zinc, cadmium, or an alloy, although silver is a preferred material. The fuse element 20 may comprise a plurality of conductors, electrically connected in parallel and wrapped about the core 10.

The fuse element 20 further has a plurality of circular perforations 22, spaced longitudinally to define reduced cross-sections which facilitate vaporization of the fuse element 20 under fault current conditions, resulting in formation of a number of arcs in series. The perforations 22 are shown in FIG. 1 as being circular in shape, however, some or all of the perforations may also be formed in other appropriate shapes, for example, ovals, rectangles, etc. Furthermore, the reduced cross-section can be formed by employing notches in the sides of the fuse element as well as perforations in the middle portion as shown. The fuse element 20 is wound about core 10 in the desired pattern, preferably spirally or helically, and the end potions of the fuse element 20 are then affixed at their final or terminal position to the terminals or ferrules 32 of the fuse.

To initiate fuse operation at relatively low level overload currents, it is known to provide a fuse element with a conventional tinned portion or overlay, such as tinned portions or overlays 24, with each overlay disposed adjacent to one of the perforations 22. When a fuse element 20 is heated by an overload current that persists for a predetermined duration, overlays 24 begin to melt and to alloy with the underlying material the fuse element. The overlay when alloyed with the material of the fuse element increases the local electrical resistance of the fuse element where alloying takes place. The increased resistance dissipates additional heat energy and accelerates melting or vaporization of the fuse elements 20 at these locations. This reduces the time required to form associated arcs at the various locations along the fuse element.

In order to improve the ability of the core 10 to withstand voltages applied along its length, notches or cut-outs 14 are provided in the radially outer edges of the fins 12 of the core 10. The dielectric breakdown along the solid surface of a core 10, for example, ceramic, is typically less than that through a similar distance of a pulverulent arc-quenching filler medium, for example, sand, mica or quartz. The dielectric breakdown between two points on the core 10 may be improved by increasing the distance along the surface of core 10 between the points. The cut-outs 14 are placed in the outer surface areas of the fins of the core 10 to increase the surface length along core 10 between two given points, and therefore to improve its dielectric breakdown characteristic. The surface distance of particular interest that is increased, is the distance between the locations at which the fins 12 are contacted by adjacent turns of the fuse element 20, so as to increase the voltage necessary to cause a dielectric breakdown between adjacent turns of the fuse element 20. This aspect, wherein the breakdown voltage needed to overcome the dielectric strength of the core along its surface is increased, is commonly referred to as an increase in the creepage between adjacent turns of the fuse element.

As further shown in FIG. 1, a pair of electrically conductive terminal rings 34 are attached to the opposite ends of the core 10. The fuse element 20 is electrically coupled to the terminal rings 34 by suitable means. The terminal rings 34 further contain electrically conductive tabs 36 and 38 that are conductively attached to the terminals or ferrules 32 on the tubular casing 30 to provide an electrical interconnection between the fuse element 20 and the ferrules 32. The tubular casing 30 is typically made of an insulated material, for example, glass reinforced epoxy. The pair of terminals or ferrules 32 are attached to the opposite ends of a tubular casing 30 by suitable means closing each of the opposite ends of the tubular casing 30, and are typically made of an electrically conductive material, such as, for example, copper. The ferrules 32 provide the electrical interconnection means between the fuse element 20 and an external circuit (not shown). Other interconnection means can be used to electrically interconnect the fuse element to the ferrules, as are known in the art.

Figure 3:
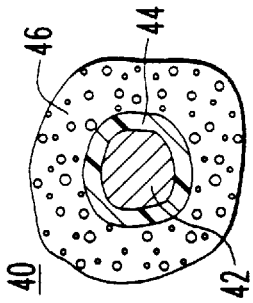
FIG. 3 an illustration of the surface modified arc-quenching filler particle according to the invention.

Also shown in FIG. 1, according to the invention, the tubular insulating casing 30 is filled with a modified pulverulent arc-quenching filler material 40, especially in the immediate vicinity of the arc-initiating fuse element. According to the invention, the modified pulverulent arc-quenching filler material 40 at its surface is bonded to and thus modified by an arc-quenching gas-evolving material as shown in FIG. 3. In conventional high voltage current limiting fuses, an arc quenching filler material such as, for example, sand, occupies substantially all of the space within the tubular casing that is not occupied by the core and the fuse element. The typical arc-quenching filler material serves in a conventional manner to cool arcing, and thereby to assist in extinguishing the arcs that are developed when the fuse element is vaporized under fault current conditions, to complete the current interruption process. However, by providing arc-quenching filler particles 42 with a surface modification of gas-evolving material 46 according to the invention, some important results are obtained. The modified pulverulent arc-quenching filler material 40 assists rapidly and effectively to quench the arc during fault current conditions, while also reducing fulgurite formation within the arc-quenching filler material. These results are achieved while maintaining advantageous free-flowing and compacting characteristics of the pulverulent arc-quenching filler material.

Referring to FIG. 3, the invention is particularly directed to providing a pulverulent arc-quenching filler material 40 having its surface modified or coated with a gas-evolving material 46. The surface modified or coated pulverulent arc-quenching filler material 40 reduces the tendency for restriking or tracking of the arc during arcing conditions. The free-flowing and compacting characteristics assist in the ability to position the coated pulverulent arc-quenching filler 40 locally in the immediate vicinity of the arc-initiating fuse element 20, where the arcing occurs. These characteristics prevent the modified arc-quenching filler 40 from settling and moving outside of the arcing region at one or more points along the length of the fuse element.

It has been found particularly advantageous to fill the tubular casing 30 with layers of coated and uncoated arc-quenching filler material, by conventional compacting and vibrating techniques, in order to provide the coated pulverulent arc-quenching filler 40 only in the localized arcing regions. This further reduces pressure build-up in the fuse upon gas evolution.

The surface modified or coated pulverulent arc-quenching filler 40 provides a gas-evolving surface that improves the arc-quenching characteristics and effectiveness of the arc-quenching filler material per se. The surface modified or coated pulverulent arc-quenching filler 40 minimizes fulgurite formation in the fusing region and/or fulgurite conductivity upon fulgurite formation, both of which help to minimize the opportunity for the arc to restrike along a path other than along the fuse element. Moreover, the gas-evolving material 46 is particularly selected to be made from relatively non-carbonizing materials to minimize carbon residue tracking of the arc upon arcing conditions.

Preferably, the pulverulent arc-quenching filler material to be modified has a high dielectric strength. Appropriate pulverulent arc-quenching filler material preferably is selected generally from the group of silica and silicates, and more particularly from one or more of sand, mica, quartz or the like. Other arc-quenching fillers which can be used include glass, fiber, asbestos and the like. The arc-quenching filler is preferably provided in a granular, free-flowing form, preferably bead granules. Even more preferably, the arc-quenching filler material is a silica having consistent particle size distribution, such as GRANUSIL, sand sold by Unimin Corporation.

As shown in FIG. 3, the surface of arc-quenching filler particles 42 are coated with gas-evolving material 46. The gas-evolving material 46 is attached physically and/or chemically to the surface of the arc-quenching filler particles 42 by a binder material 44 to form the modified or coated arc-quenching filler 40 according to the invention. Preferably, each of the primary arc-quenching filler particles 42 are coated with a gas-evolving compound 46. The binder 44 is selected from the group of relatively non-tracking adhesives such as acrylics, urethanes, melamines, epoxies and polyesters or the like, acrylics being preferred. The binder 44 attaches the gas-evolving compound 46 to the surface of the arc-quenching filler particles 42. Even though an acrylic binder is high in carbon content, the acrylic upon arcing conditions decomposes to its monomer structures, with minimal adverse carbonizing properties and carbon residues. Consequently, minimal restriking or tracking of the arc occurs.

The gas-evolving material 46 is preferably selected from compounds possessing rapid gas-evolving properties, minimal tracking properties, high electrically non-conductive properties, high insulating properties and high thermal properties. The gas-evolving material is preferably selected from a compound high in nitrogen content and low in carbon content, minimize tracking from carbon (graphite) residues formed in the circuit interruption device when exposed to arcing conditions and high temperatures. More preferably, the gas-evolving material is a nitrogen heterocyclic compound. Even more preferably, carbonates, acetates, phosphates salts or the like derived from a nitrogen heterocyclic compound are particularly desirable because of their high thermal stability.

The gas-evolving material 46 that is applied to the surface of the arc-quenching filler include materials which evolve a gas in the presence of an arc, such as, for example, guanidine carbonate, guanidine acetate, guanidine, 1,3-diphenyl guanidine, guanine, cyanuric acid, melamine, melamine cyanurate, urea, urea-phosphate, hydantoin, allantoin, and the like, and/or derivatives and mixtures thereof. Even more preferably, the gas-evolving materials are selected from the group of guanidine carbonate, hydantoin, and urea-phosphate. The gas-evolving material loading in the modified arc-quenching filler is preferably 2 to 70% by weight of the modified arc-quenching filler material, even more preferably 5 to 40% by weight, and most preferably up to 20% by weight of the modified pulverulent arc-quenching filler material.

The current limiting fuse can also contain separate gas-evolving members (not shown) which evolve a gas in the presence of an arc. The evolved gas further aids in the extinction of the arc conditions within the fuse housing which occurs when a fuse element is subjected to overload or fault current conditions. The gas-evolving members can be positioned within cut-outs on the fins of a core, integrally formed from the core, coated onto the core, fuse element or casing, or secured to the fuse element. A detailed description of the construction and operation of high voltage current limiting fuses and of localized placement of separate gas-evolving structures is taught, inter alia, in U.S. Pat. Nos.

4,319,212 (Leach); 4,339,742 (Leach, et al.); and, 4,099,153 (Cameron), each of which is incorporated by reference herein.

According to the method of making the modified pulverulent arc-quenching filler 40 according to the invention, it has been found particularly advantageous first to suspend a supply of arc-quenching filler particles, for example, sand, preferably rounded sand and having a uniform particle size distribution, in a binder solution to provide a surface coating of the binder on the arc-quenching filler particles, particularly the primary particles. The binder solution can include binder in a liquid carrier selected from the group of toluene, xylene, methyl ethyl ketone, methyl iso-butyl ketone or the like and mixtures thereof. The binder coated arc-quenching filler particles are then brought into contact with the gas-evolving materials, preferably in powdered form. By this method, the powdered gas-evolving material readily attaches itself to the arc-quenching filler particles and forms a layer of gas-evolving materials around the arc-quenching filler particles. The amount of gas-evolving materials attached to the surface of the arc-quenching filler particles is a function of the amount of binder, the particle size of the gas-evolving compound, and the amount of gas-evolving compound. Loadings of the gas-evolving material of up to 20% by weight of the modified arc-quenching filler are especially preferred. Once the arc-quenching filler is modified with the gas-evolving compounds, the modified arc-quenching filler exhibits normal free-flow characteristics with minimal clumping and agglomeration, because the binder is no longer exposed on the surfaces. Other methods of coating, such as spraying or the like, can also be used.

Thus, the method of modifying the surface of the filler material with a gas-evolving compound comprises the steps of providing a supply of pulverulent arc-quenching filler material; suspending the pulverulent arc-quenching filler material in a binder solution; drying the pulverulent arc-quenching filler and binder to tackiness; applying a gas-evolving compound to the binder coated arc-quenching filler particles; and, drying the resulting surface modified pulverulent arc-quenching filler material. The modified pulverulent arc-quenching filler material is loaded into the space within the tubular casing 30 that is not occupied by the fuse element and core. It has been found particularly advantageous to position the modified pulverulent arc-quenching filler material locally, in areas of the fuse housing where arcing will occur.

During the operation of the high voltage current limiting fuse device 1, when the current applied to the fuse element 20 exceeds the current carrying capability of the fuse element 20, the excessive current produces resistive heating that initiates melting of the fuse element 20. When the fuse element 20 is subjected to this fault magnitude current, the fuse element quickly attains fusing temperatures and vaporizes. Arcing occurs and the metal vapor rapidly expands to many times the volume originally occupied by the fuse element 20. These vapors are emitted into the spaces between grains of the modified pulverulent arc-quenching filler material 40, where they condense through heat transfer into the modified arc-quenching filler, and are no longer disposed in a condition for current conduction. The current limiting effect of the fuse as a whole results from the introduction of arc resistance into the circuit. During arcing conditions, the gas-evolving compounds 46 attached to the surface of the modified pulverulent arc-quenching filler rapidly evolve a deionizing gas, thereby reducing free ions available for conduction along the arc, damping the arcing as well as reducing the incidence of tracking or restriking of the arc.

It is desirable that the physical contact between the hot arc initiated by the melting of the fuse element 20 and the relatively cooler modified filler granules 40 cause a rapid transfer of heat from the fuse element to the granules, thereby dissipating most of the arc energy with little pressure build-up within the fusing casing 30. It is also desirable that the modified arc-quenching filler material 40 is disposed in the immediate vicinity of the arc-initiating fuse element 20 as it melts and absorbs arc energy. The modified arc-quenching filler 40 is preferably locally positioned only in areas where arcing occurs by layering modified and unmodified filler inside the casing. Any resulting fulgurite from the fusing and sintering of the arc-quenching filler particles provides a semiconducting glass body which would enhance restriking of the arc. However, the gas-evolving materials 46 attached to the filler particle expel their gas during arcing conditions which not only provides a deionizing action on the arc but it is believed to also provide a cooling action on the fulgurites formed. The cooled fulgurites become insulating upon cooling, and the deionizing action reduces fulgurite formation in the first place. The gas-evolving compounds positioned on the surface of the arc-quenched filler are provided in such an amount that only slight pressure build-up within the fuse enclosure results as the evolved gas forms.

The modified pulverulent arc-quenching filler 40 can occupy approximately all of the unoccupied space within the tubular casing 30, which can be enhanced with the assistance of a suitable means such as a vibrating or shaking of the casing during loading. The modified pulverulent arc-quenching filler can also occupy only localized regions of arcing, unmodified filler occupying the remainder of the unoccupied space within the tubular casino 30. Thus, it is important to maintain free-flowing and compacting characteristics of the filler material.

The invention will be further clarified by a consideration of the following example, which is intended to be purely exemplary of the invention.

EXAMPLE 1

Preparation Of Surface Modified Arc-Quenching Filler Material 170 grams of pulverulent arc-quenching filler particles, granular round sand (approximately 100 ml volume), were treated in a beaker with a diluted solution of an acrylic coating adhesives. The acrylic coating adhesive had been diluted with toluene in a ratio of 2:1. The resulting slurry was then stirred for approximately five (5) minutes to thoroughly suspend and coat the sand filler particles with the adhesive. The suspension was then allowed to stand for approximately two (2) minutes to allow the sand to settle to the bottom of the beaker. The excess acrylic adhesive solution was decanted off and the acrylic treated sand was air-dried to tackiness for approximately five (5) minutes to allow excess solvent to evaporate, while sitting in an aluminum pan. The dried sand (still tacky) was then mixed in four (4) separate aluminum pans with different powdered gas-evolving materials: (Sample 1) 19% (by weight) guanidine carbonate, (Sample 2) 2% (by weight) guanidine carbonate, (Sample 3) 10.5% (by weight) hydantoin, and Sample 4) 19% (by weight) urea-phosphate. The filler sand and the gas-evolving powder were mixed thoroughly together and then allowed to air dry. After drying, the modified sand had very small clumps which could be easily broken up into granular form.

Figure 4:
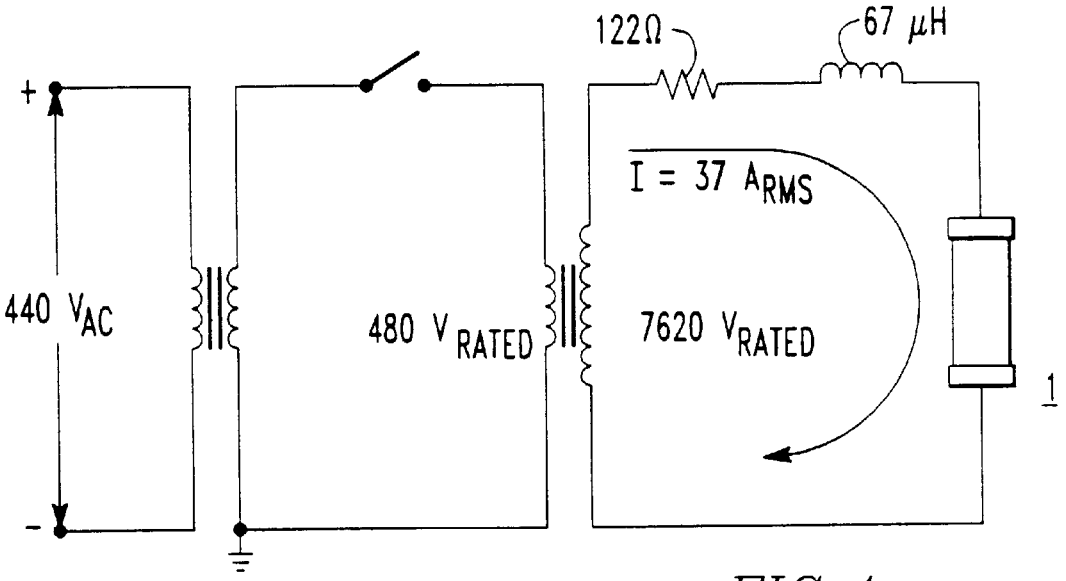
FIG. 4 is a schematic diagram showing a test instrument used for determining the arc-quenching effectiveness of the surface modified pulverulent arc-quenching filler material according to the invention.

The arc-quenching effectiveness of the four (4) samples was tested using the following test procedure. The circuit used to test the fuses containing the coated sand is shown in FIG. 4. A high voltage distribution transformer was used to provide a realistic recovery voltage across the fuse. The circuit parameters were chosen to give a current of 37 $A_{RMS}$ through the fuse under the test. The arcing time was recorded as the time of the current flow in the fuse. The fuse used to test the modified sand filler was constructed from a 17 inch long insulating tube and a single silver fuse element. Prior to assembling the fuse, a drop of tin solder was placed on the center of the fuse element to lower the melting point of the silver element in the soldered area and thereby assure that arcing took place in the center of the fuse.

The fuse element was fed into the tube and an uncoated round sand (25 ml) was poured and compacted into the fuse tube to fill the bottom ⅓ of the tube, followed by modified sand (30 ml) according to the (4) samples into the center of the tube, and then having the tube topped off with uncoated round sand (25 ml). Therefore, only the center part of the tube, where arcing was expected, was filled with the coated sand in order to conserve the treated sand and also to minimize pressure-buildup in the tube. The fuse was then melted at the tinned area by passing 12 $A_{DC}$ current for ten (10) minutes and tested in the circuit as shown in FIG. 4.

The results obtained with the (4) samples are summarized in Table 1. The "arcing timed" values are a measure of the arc-quenching capabilities of the various modified pulverulent arc-quenching fillers, the lower the value the more effective the material.

TABLE 1

Arc-Quenching Effectiveness Of Coated Sand Samples

| Sample No. | Gas-Evolving Additive Used | % By Weight in Sand | Arcing (Milliseconds) |
|---|---|---|---|
| Control | None | 0.0 | >240* |
| 1 | Guanidine Carbonate | 19.0 | 68 |
| 2 | Guanidine Carbonate | 2.0 | 204 |
| 3 | Hydantoin | 10.5 | 79 |
| 4 | Urea-phosphate | 19.0 | 97 |

*The control material (uncoated sand) failed to interrupt the arc, and, therefore, the arc was mechanically interrupted after 240 miliseconds.

The invention having been disclosed in connection with the foregoing specification and example, additional variations will now be apparent to persons skilled in the art. The invention is not intended to be limited to the variations specifically mentioned, and accordingly reference should be made to the appended claims rather than the foregoing discussion of the specification and example, to assess the true scope and spirit of the invention in which exclusive rights are claimed.

We claim:

1. A gas-evolving pulverulent arc-quenching filler composition, comprising:

a pulverulent arc-quenching filler, a binder, and a gas-evolving material, wherein the gas-evolving material is bound by the binder to a surface of the pulverulent arc-quenching filler, said composition being formed as a free-flowing pulverulent.

2. The composition of claim 1, wherein the pulverulent arc-quenching filler is selected from the group consisting of silicas and silicates.

3. The composition of claim 1, wherein the pulverulent arc-quenching filler is selected from the group consisting of sand, mica and quartz.

4. The composition of claim 3, wherein the pulverulent arc-quenching filler is a granule, said composition being in the form of a free-flowing granule.

5. The composition of claim 3, wherein the pulverulent arc-quenching filler is a bead granule, said composition being in the form of a free-flowing bead.

6. The composition of claim 1, wherein the binder is selected from the group of resins consisting of acrylics, urethanes, epoxies, melamines, and polyesters.

7. The composition of claim 3, wherein the binder is an acrylic resin.

8. The composition of claim 7, wherein the gas-evolving material is selected from the group consisting of guanidine carbonate, hydantoin and urea phosphate.

9. The composition of claim 1, wherein the gas-evolving material is selected from the group consisting of melamine, cyanuric acid, melamine cyanurate, guanidine, guanidine carbonate, guanidine acetate, 1,3-diphenylguanidine, guanine, urea, urea phosphate, hydantoin and allantoin.

10. The composition of claim 1, wherein the gas-evolving material is bound to the surface of each of the primary particles of the arc-quenching filler.

11. The composition of claim 1, wherein loading of the gas-evolving material is up to about 20% by weight of the pulverulent arc-quenching filler.

12. A method of making a gas-evolving pulverulent arc-quenching filler composition, comprising:

(a) providing a supply of pulverulent arc-quenching filler particles;

(b) suspending the pulverulent arc-quenching filler particles in a binder in solution, to coat a surface of the pulverulent arc-quenching filler particles with a binder coating;

(c) drying the pulverulent arc-quenching filler particles and the binder coating to tackiness;

(d) applying a gas-evolving material to the arc-quenching filler particles and binder coating, to coat a surface of the pulverulent arc-quenching filler particles and the binder coating with the gas-evolving material; and, (e) drying the gas-evolving pulverulent arc-quenching filler particles, to form a composition of free-flowing particles.

13. The method of claim 12, wherein the pulverulent arc-quenching filler particles are selected from the group consisting of granular sand, mica or quartz.

14. The method of claim 12, wherein the gas-evolving material is selected from the group consisting of powdered melamine, cyanuric acid, melamine cyanurate, guanidine, guanidine carbonate, guanidine acetate, 1,3-diphenylguanidine, guanine, urea, urea phosphate, hydantoin and allantoin.

15. The method of claim 12, wherein the binder is selected from the group of resins consisting of acrylics, urethanes, epoxies, melamines, and polyesters.

16. A high voltage current limiting fuse, comprising:

a generally tubular casing of electrically insulating material; a pair of terminal elements closing each of the opposite ends of said tubular casing; at least one fuse element conductively interconnecting said pair of terminal elements; a core for supporting said at least one fuse element longitudinally extending parallel to the longitudinal axis of said tubular casing; a plurality of gas-evolving pulverulent arc-quenching fillers inside said tubular casing in close proximity to the fuse element, wherein each gas-evolving pulverulent arc-quenching filler comprises a pulverulent arc-quenching filler, a binder, and a gas-evolving material, wherein the gas-evolving material is bound by the binder to surfaces of the pulverulent arc-quenching filler, said gas-evolving pulverulent arc-quenching fillers being in the form of a free-flowing pulverulent.

17. The composition of claim 1, wherein the composition is filled in the casing around a high voltage current limiting fuse.

18. The composition of claim 8, wherein the composition is filled in the casing around a high voltage current limiting fuse.

19. The method of claim 15, wherein the binder is dissolved in a liquid carrier selected from the group consisting of toluene, xylene, methyl ethyl ketone, and methyl isobutyl ketone.

20. The fuse of claim 16, wherein the gas-evolving pulverulent arc-quenching fillers inside the tubular casing further comprise a pulverulent arc-quenching filler selected from the group consisting of sand, mica end quartz, a binder selected form the group consisting of acrylic, urethane, epoxy, melamire and polyester resins, and a gas-evolving material selected from the group consisting of melamine, cyanuric acid, melamine cyanurate, guanidine, guanidine carbonate, guanidine acetate, 1,3-diphenylguanidine, guanine, urea, urea phosphate, hydantoin and allantoin.

21. The fuse of claim 16, wherein the gas-evolving pulverulent arc-quenching fillers in the tubular casing further comprises a pulverulent arc-quenching filler comprising sand, a binder comprising acrylic resin, and a gas-evolving material selected from the group consisting of guanidine carbonate, urea phosphate, and hydantoin.

22. The fuse of claim 21, wherein the loading of the gas-evolving material is from about 2 to 70% by weight of the pulverulent arc-quenching filler.

23. The fuse of claim 21, wherein the loading of the gas-evolving material is up to about 20% by weight of the pulverulent arc-quenching filler.

24. The fuse of claim 20, wherein the pulverulent arc-quenching filler is a granule, said gas-evolving pulverulent arc-quenching fillers being in the form of free-flowing granules.

25. The fuse of claim 20, wherein the pulverulent arc-quenching filler is a bead granule, said gas-evolving pulverulent arc-quenching fillers being in the form of free-flowing beads.

26. The fuse of claim 16, wherein the gas-evolving pulverulent arc-quenching fillers occupy all of the unoccupied spaces inside the tubular casing.

* * * * *